United States Patent [19]

O'Brien et al.

[11] Patent Number: 4,814,961

[45] Date of Patent: Mar. 21, 1989

[54] LIGHT FIXTURE

[75] Inventors: Steven T. O'Brien, Champlin; Jay J. Kakuk, Plymouth; Robert W. Beachy, St. Paul, all of Minn.

[73] Assignee: The Toro Company, Minneapolis, Minn.

[21] Appl. No.: 116,997

[22] Filed: Dec. 21, 1987

[51] Int. Cl.[4] ..... F21V 17/02

[52] U.S. Cl. ..... 362/319; 362/291; 362/354

[58] Field of Search ..... 362/290, 291, 325, 319, 362/342, 354

[56] References Cited

U.S. PATENT DOCUMENTS

| | | | |
|---|---|---|---|
| D. 263,340 | 3/1982 | Budnovitch . | |
| D. 284,312 | 6/1986 | Patel . | |
| 1,396,936 | 11/1921 | Locke . | |
| 1,495,514 | 5/1924 | Gunnison . | |
| 2,886,354 | 5/1959 | Bjorklund . | |
| 3,197,243 | 7/1965 | Brenneke . | |
| 3,352,191 | 11/1967 | Crawford . | |
| 3,438,660 | 4/1969 | Steiner . | |
| 3,593,014 | 7/1971 | Vesely | 362/291 |
| 3,672,708 | 6/1972 | Zemberry . | |
| 3,833,804 | 9/1974 | Vesely | 362/291 |
| 3,838,928 | 10/1974 | Blaurock et al. . | |
| 4,293,898 | 10/1981 | Budnovitch et al. | 362/291 |
| 4,376,254 | 3/1983 | Hellmann . | |
| 4,507,715 | 3/1985 | Wedding . | |
| 4,626,974 | 12/1986 | Dean . | |

*Primary Examiner*—Stephen F. Husar
*Attorney, Agent, or Firm*—R. Lawrence Buckley

[57] ABSTRACT

A light fixture (10) including a bulb/lens assembly (12), a hollow post (14) and a ground stake (16). An assembly ring (18) having inner and outer "fingers" (104 and 106, respectively) securely connects the bulb/lens assembly (12) to the post (14). Bulb/lens assembly (12) includes a lens (28) which carries a plurality of louvers (40, 42 and 44). Some of the louvers include legs (46, 50) and slots (60, 62) so that the distance between the louvers can be adjusted to vary the appearance of light fixture (10) and the amount of light produced thereby.

12 Claims, 4 Drawing Sheets

LIGHT FIXTURE

FIELD OF THE INVENTION

The present invention relates generally to light fixtures, and more particularly to low voltage post lights.

BACKGROUND OF THE INVENTION

Although aspects of the present invention could be applied to indoor light fixtures, the following description will focus on the preferred application, outdoor light fixtures. There are many types of outdoor light fixtures, including lights which are mounted on posts and lights which are supported by brackets or short pointed ground stakes. The present invention is primarily directed toward post lights, although those ordinarily skilled in the art will recognize that aspects of the invention could be applied to other types of outdoor and indoor light fixtures.

Post lights should preferably have several features. Importantly, they should be affordable and weather resistant. Some post lights are made of wood and these have a tendency to rot when set into wet and soggy ground. Even the upper, above-ground portion of such post lights tends to rot due to exposure to weather elements. Post lights should also be easy to assemble and install since they are oftentimes installed by homeowners. Finally, the Applicants are of the opinion that post lights should be attractive as well: one of their primary functions is to enhance the attractiveness of homes and businesses, and if the fixtures themselves are unattractive or aesthetically incompatible with the grounds or architecture, they will be unacceptable to purchasers and will not fulfill their intended function. In view of the wide variety of tastes, styles, and uses, the Applicants believe that post lights should preferably be somewhat adjustable or flexible so that they can be modified to suit the purpose at hand.

Given the preferred features outlined above, it is perceived that plastic is an advantageous construction material. Although plastic post lights can be manufactured in a variety of ways, Applicants have found that it is preferable to fabricate such lights by extruding the post portion of the fixture and injection molding the bulb/lens assembly which sits atop the post. If the light fixture is so fabricated, however, joining the post and the bulb/lens assembly is problematical. Screws, rivets or other standard connectors are relatively expensive; sometimes require special or additional tools; and detract from a clean, high quality appearance. Further, they are often tamper-prone and can actually provide means for water to get inside of and damage the fixture. And, because the post is extruded it is impossible to use a threaded or bayonet connection between the post and the bulb/lens assembly. One aspect of the present invention is a technique for economically and securely joining an extruded post to an injection molded bulb/lens assembly. The technique disclosed herein provides such features in spite of the fact that the typical tolerance on an injection molded part is about 0.005 inch and the typical tolerance on an extruded three or four inch tube or post is on the order of 0.065 inch.

As discussed above, Applicants perceive that in addition to weather resistance and cost-effectiveness it is preferable to have a flexible or convertible post light that can be modified to suit the purpose at hand. Although louvers or baffles are normally found on "temple" lights such as the light shown in U.S. Pat. No. Des. 284,312, and not on post lights, the post light of the present invention preferably includes louvers which can be adjusted as desired. More louvers, spaced closer together, provide an oriental look with less outward-emanating light; fewer louvers spaced further apart provide a contemporary look and offer more outward-emanating light and greater light output in general.

The prior art, i.e., U.S. Pat. No. 1,396,936, issued to A. R. Locke, includes a lighting fixture which appears to have means for adjusting the spacing between its baffles or louvers. The Locke fixture includes a plurality of rings or louvers which are placed one above the other and are spaced apart by hollow spacing bushings located toward the outer edge of the fixture. The bushings are of such a height that there are slits between adjacent rings for the passage of light. By making the bushings of different heights the amount of light which escapes these slits can be varied. Relatively long screws which function as tie rods pass through the rings and bushings and tie the entire assembly together. Although the Locke fixture is advantageous in that it appears to include means for varying the distance between the rings or baffles, it is perceived that the adjustable bushing technique is disadvantageous for several reasons. For one thing, providing several different length bushings is expensive, and it is likely that the owner will misplace the bushings which are not currently being used. Also, assembly of the fixture is difficult. Finally, the bushings themselves are rather bulky and tend to unacceptably diminish the light emanating through the slits between the rings. The present invention addresses these problems: an aspect of the present invention is a technique for conveniently varying the number and distance between baffles or louvers such that the entire look and function of the light fixture can be varied depending on the application.

SUMMARY OF THE INVENTION

Accordingly, one embodiment of the invention is a light fixture including a light source and a plurality of adjustable louvers. Each of the louvers includes a skirt and a plurality of legs extending from the skirt suitable for engaging an adjacent louver. Each skirt forms a plurality of slots suitable for receiving the legs of the adjacent louver, some of the slots being shallow and some deep, wherein when the shallow slots are used adjacent louvers are in their most spaced state, and when the deep slots are used adjacent louvers are in their least spaced state. Thus, the number of louvers and spacing therebetween can be adjusted depending on the desired appearance and light output.

In a preferred embodiment, the legs and slots are substantially T-shaped and the deep and shallow slots overlap such that when the legs are in the shallow slots a portion of each of the legs extends into the adjoining deep slot.

Another embodiment of the invention is a louver assembly wherein each louver includes a skirt and a plurality of legs extending from the skirt suitable for engaging an adjacent louver.

Another aspect of the invention is a technique for interconnecting the bulb/lens assembly of a light fixture to a post. The technique makes use of an assembly ring wherein the assembly ring includes a band and a plurality of fingers extending radially from the band suitable for engaging the bulb/lens assembly and the post. Use of an assembly ring of the type described above is particularly useful when the bulb/lens assembly is injection molded and the post is extruded.

The assembly ring is preferably metal and includes inner fingers which extend radially inward and downward suitable for engaging the bulb/lens assembly; and outer fingers which extend radially outward and upward suitable for engaging the inner surface of the hollow post.

Additional features and aspects of the invention are described below with reference to the appended Drawings.

DETAILED DESCRIPTION OF THE INVENTION

Figure 1:
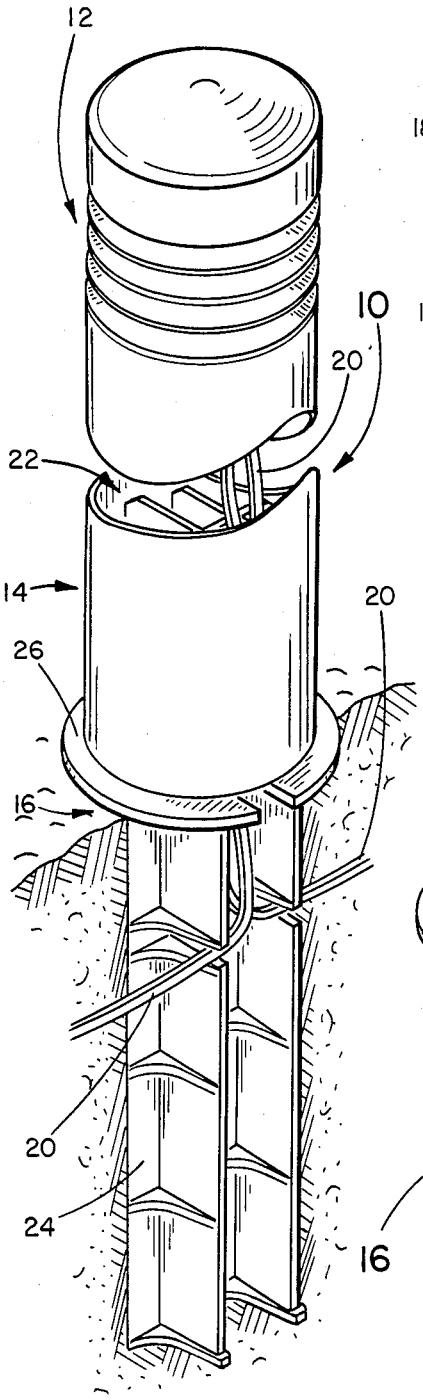
FIG. 1 is a perspective view of a post light fixture according to the invention, assembled and in the ground.

Referring to the Drawings, wherein like reference numerals designate like parts and assemblies throughout the several views, FIG. 1 illustrates a perspective view of a preferred light fixture 10 according to the invention, inserted into the ground.

Light fixture 10 includes as its basic component a light source or bulb/lens assembly 12; an upright post 14; a ground stake 16; and an assembly ring 18 for connecting bulb/lens assembly 12 to post 14. As shown, stake 16 is inserted into the ground and the bottom end of post 14. Post 14 extends upward and supports at its uppermost end bulb/lens assembly 12. A cable 20 or another wire connected thereto runs up hollow post 14 to bulb/lens assembly 12. Cable 20 is also connected to a low voltage power source and optionally to other post lights (not shown). Each of the major components of light fixture 10 is described below in some detail.

Stake 16

Figure 2:
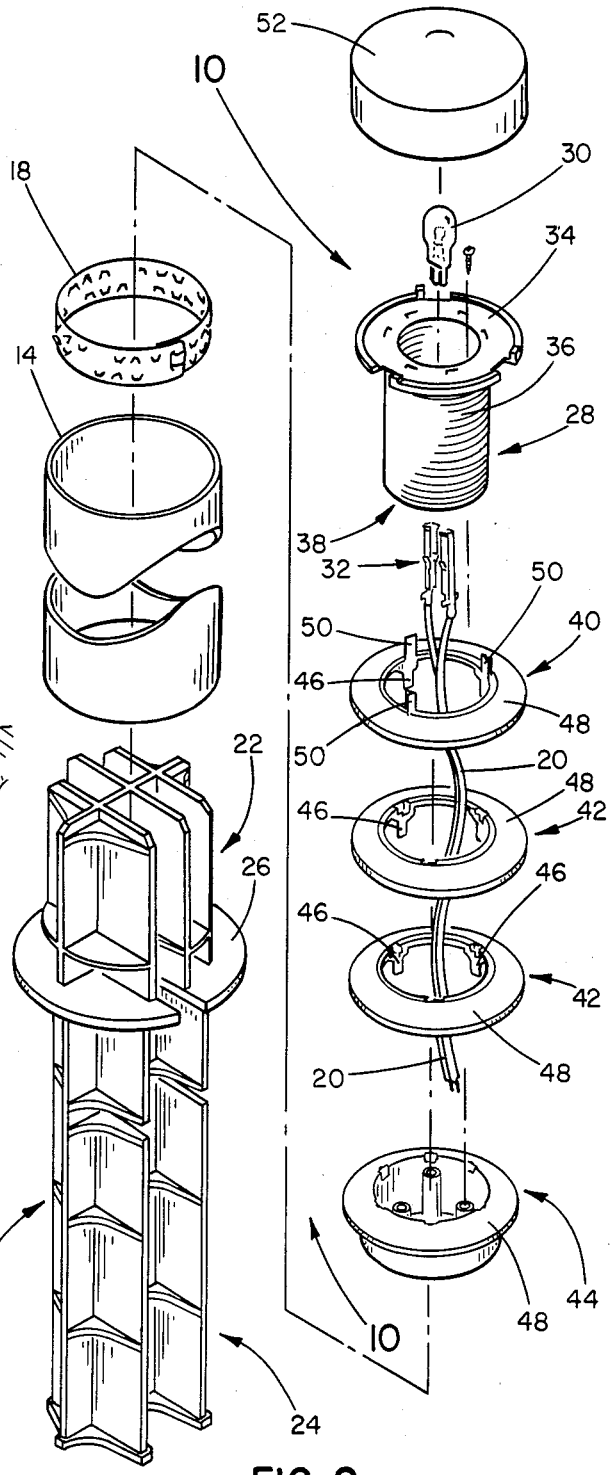
FIG. 2 is an exploded view of the light fixture of FIG. 1, showing the stake, post, bulb/lens assembly, and assembly ring.

Stake 16 is preferably injection molded polypropylene and includes an upper portion 22 suitable for insertion into the bottom of post 14; and a lower "H"-shaped portion 24 suitable for burying in the ground. A circular flange 26 separates stake portions 22 and 24 and serves as a supporting base for post 14. It should be noted that stake 16 could be replaced by a mounting plate or the like suitable for connecting to a wooden deck, for example. Such a mounting plate would still include an upper portion much like upper portion 22 shown in FIGS. 1 and 2, but would not include an elongate lower portion 24. Instead, the bottom portion would typically be apertured to receive wood screws so that the bottom portion could be secured to wooden decking or railing.

Post 14

Extending upward from stake 16 is post 14, preferably made of extruded high density polyethylene. Post 14 is about 28 inches long, in one embodiment, and 3.50 inches in outside diameter. The wall thickness of post 14 is preferably about 0.10 inch. As shown in FIG. 1, bulb/lens assembly 12 is located a preselected distance above the ground surface, this distance being primarily determined by the length of post 14. Post 14 can be manufactured and sold in any convenient length, and can be cut off or partially inserted into the ground to change the distance between the light source 12 and the ground.

Bulb/lens Assembly 12

Inserted into the top end of post 14 is bulb/lens assembly 12. With initial reference to FIG. 2, bulb/lens assembly 12 can now be described in some detail. Bulb/lens assembly 12 includes a substantially cylindrical lens 28 which surrounds a bulb 30. Bulb 30 is held by a pair of contacts 32 crimped to cable 20 which in turn is connected to a low voltage (e.g., 12 volts AC) power supply (not shown). Contacts 32 can be of any type suitable for conductively holding bulb 30, but preferably are similar to those shown and described in copending commonly-owned U.S. patent application Ser. No. 50,842, filed May 15, 1987, incorporated herein by reference, except for the fact that contacts 32 are crimped to cable 20 whereas the contacts shown in the aforementioned copending application are of the insulation displacement type.

Lens 28 is preferably ribbed and translucent to eliminate "hot spots" and to maximize the amount and diffusiveness of light passing therethrough. It includes a top flange portion 34; a ribbed side wall portion 36; and a bottom portion 38.

Lens 28 preferably carries a plurality of annular frusto-conical louvers or baffles which angle downwardly from the cylindrical side wall 36. In the embodiment shown in the Drawings, there is a top louver 40, a plurality of middle louvers 42 and a bottom louver assembly 44. Louver assemblies 40, 42, and 44, along with all of the components of bulb/lens assembly 12 except for bulb 30, contacts 32, and screws attaching lens 28 to lower louver assembly 44, are injection molded polycarbonate. Top louver 40 and middle louvers 42 each include three downwardly extending legs 46 and a depending frusto-conical skirt 48. Also, top louver 40 includes three upwardly extending legs 50. As discussed below, legs 46 and 50 serve to adjustably space louvers 40, 42, 44 to provide a truly custom light source. To that end, top louver 40 and middle louvers 42 are designed to freely slide upon lens 28 so that they can easily be inserted, removed and adjusted, as needed.

Bottom louver assembly 44 also includes a frusto-conical downwardly-angling skirt 48. Skirts 48 preferably have an outside diameter of 3.50 inches, and form an angle with lens sidewall 36 of about 60 degrees. Legs 46 and 50 are spaced at 120° intervals around the inner peripheries of skirts 48.

At the very top of light fixture 10 is a cap 52 which attaches to lens flange 34 in bayonet fashion. Lens base 38 attaches to bottom louver assembly 44 which is in turn connected to post 14 through the use of assembly ring 18. Louvers 40 and 42 slide on lens 28 and are in effect sandwiched between lower louver assembly 44 and lens flange 34. Louvers 40, 42 and 44 and lens 28 will now be described in greater detail.

Figure 5A:
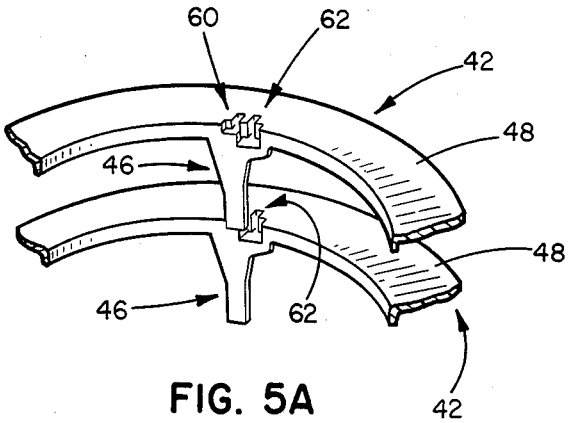
FIG. 5A is an enlarged partial view of two adjacent louvers in their most spaced state.
Figure 6:
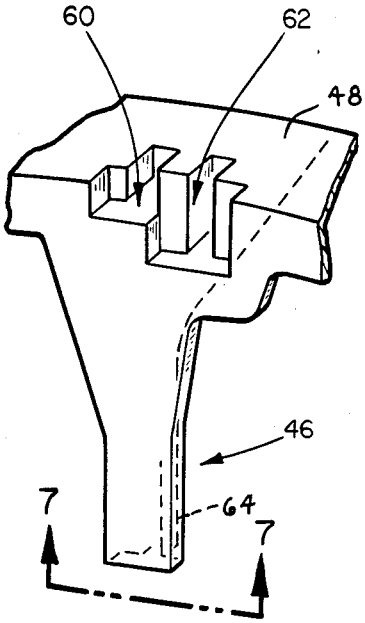
FIG. 6 is an enlarged partial perspective view of a leg of one of the middle louvers of the fixture of FIG. 1.
Figure 5B:
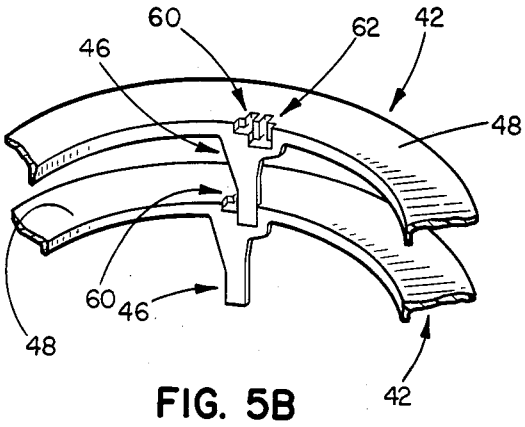
FIG. 5B is an enlarged partial view of two adjacent louvers in their least spaced state.
Figure 7:
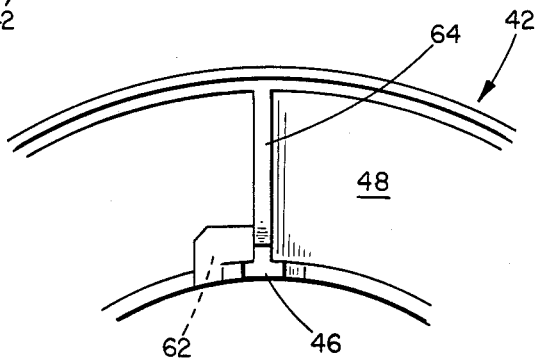
FIG. 7 is an enlarged partial bottom view of the leg of one of the middle louvers of the fixture of FIG. 1.

As noted above, louvers 40, 42 each include a skirt 48 and downwardly extending legs 46. Further, top louver 40 includes upwardly extending legs 50. Enlarged partial views of middle louvers 42 are shown in FIGS. 5 through 7. As shown, each T-shaped downwardly extending leg 46 can fit into either a shallow T-shaped slot 60 or an adjacent deeper T-shaped slot 62. FIG. 5A illustrates two middle louvers 42 in their most spaced state, i.e., with the downwardly extending legs 46 of the upper louver 42 being received by the shallow slots 60 of the lower louver 42. FIG. 5B, on the other hand, shows two adjacent louvers 42 in their most compact state, i.e., with legs 46 of the upper louver 42 inserted into the deeper slots 62 of the lower louver 42. FIG. 7 illustrates an enlarged partial bottom view of one of the middle louvers 42. It can be seen that leg 46 is T-shaped to conform to slots 60 and 62. A rib 64 reinforces leg 46 by bracing it against the underside of skirt 48. It should particularly be noted that the more shallow slot 60 is vertically aligned with the leg 46 extending downward from skirt 48. Deeper slot 62, on the other hand, is displaced slightly to one side of slot 60 and leg 46. Therefore, when shallow slots 60 are employed, legs 46 are aligned, as shown in FIG. 5A. By contrast, when the deeper slots 62 are used vertically adjacent legs 46 are not aligned, as shown in FIG. 5B.

Top louver 40 is similar to middle louvers 42 in that it includes three downwardly extending legs 46. However, top louver 40 does not include slots 60, 62 because it always constitutes the topmost louver and there is no need to receive the downwardly extending legs 46 of another louver. Instead, top louver 40 includes three upwardly extending legs 50 which have a T-shaped cross section much like downwardly extending legs 46. Legs 50 are substantially aligned with vertically adjacent legs 46.

Figure 4A:
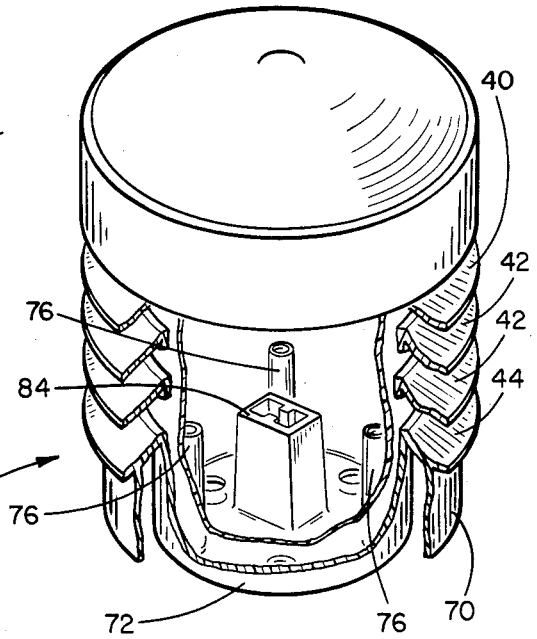
FIG. 4A is a cutaway view of the bulb/lens assembly of the fixture of FIG. 1, showing the lens in its lower position and showing four louvers in position.
Figure 4B:
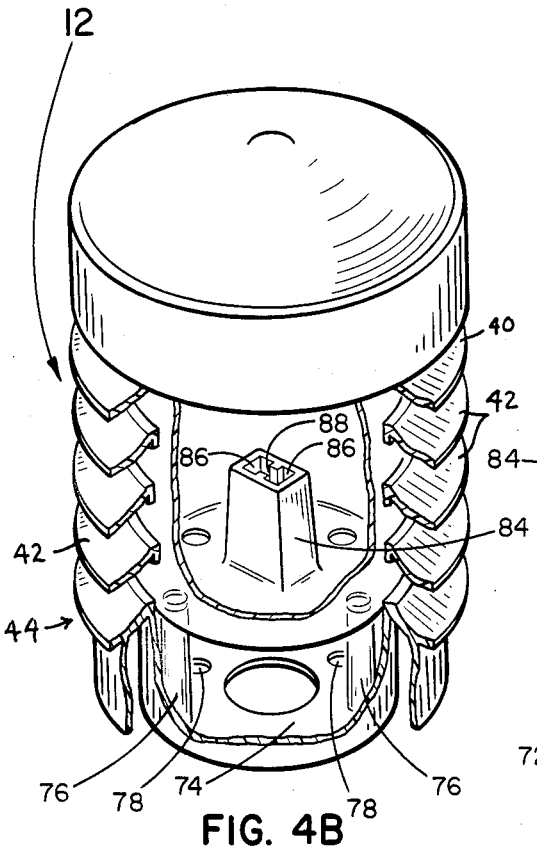
FIG. 4B is a cutaway view of the bulb/lens assembly of the fixture of FIG. 1, with the lens in its upper position and carrying five louvers.
Figure 4C:
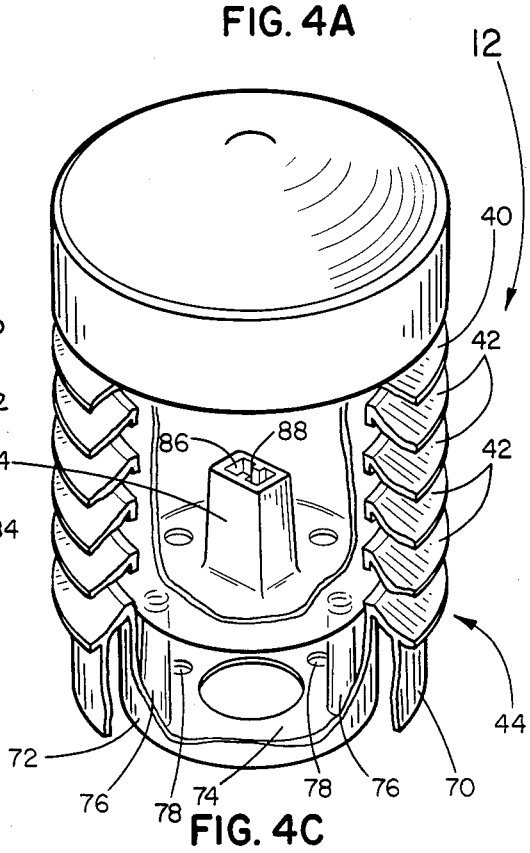
FIG. 4C is a cutaway view of the bulb/lens assembly of the fixture of FIG. 1, with the lens in its upper position and carrying six louvers.

With particular reference to FIGS. 4A–4C, attention is now directed to bottom louver assembly 44. As noted above, bottom louver assembly 44 includes an angled skirt 48 much like louvers 40 and 42. But bottom louver assembly 44 also includes a cylindrical ring portion 70 which extends vertically downward from the underside of skirt 48, joining the skirt roughly midway between its inner and outer edges; and an apertured cup section 72 which extends downward from the inner periphery of skirt 48. As further described below, ring portion 70 of bottom louver assembly 44 carries assembly ring 18 on its cylindrical outer surface and is sized to fit within the top of post 14. The primary functions of cup portion 72 are to support lens 28 and secure it to bottom louver assembly 44 and ultimately to post 14. To fulfill the lens securing function, cup portion 72 includes three roughly one inch long standards 76 extending upward from its bottom surface 74 and spaced at 120° intervals. Evenly spaced between the bosses or standards 76 are three additional holes 78. As further described above, holes 78 or bosses 76, depending on the number of louvers used, receive threaded connectors which secure lens 28 to bottom louver assembly 44.

Bottom louver assembly 44 also includes, at the top and inner periphery of skirt 48, three shallow T-shaped slots 60 and three deeper T-shaped slots 62, wherein the shallow slots are spaced at 120° intervals and the deeper slots are evenly spaced therebetween. Thus, in the bottom louver assembly 44, unlike the middle louvers 42, slots 60 and 62 do not overlap. Slots 60 or 62 of louver assembly 44 receive legs 46 extending downward from the lower middle louver 42, depending on the desired number of louvers and inter-louver spacing.

Figure 8:
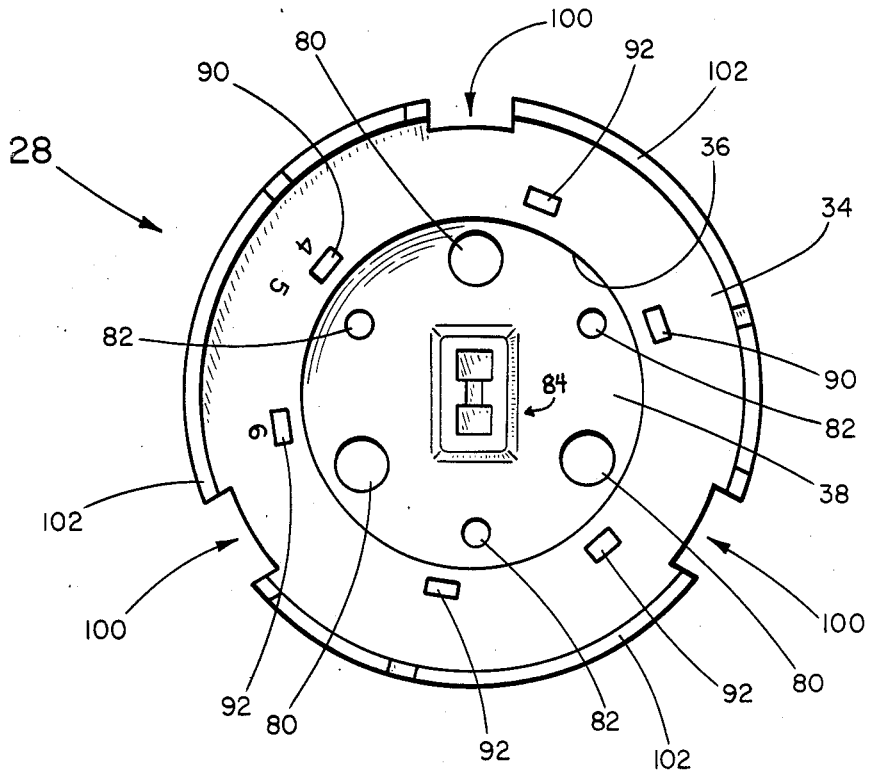
FIG. 8 is an enlarged top view of the lens of the fixture of FIG. 1.

Having described louvers 40, 42, and 44, attention is now directed to lens 28. As noted above, lens 28 includes top flange 34, sidewall 36 and circular bottom 38. As shown in FIG. 8, a top view of lens 28, the bottom portion 38 forms relatively large circular holes 80, spaced at 120° intervals, and smaller holes 82 evenly spaced therebetween. Large holes 80 are sized to loosely receive bosses 76 extending upward from the base 74 of lower louver assembly 44, as shown in FIG. 4A. When the lens 28 and lower louver assembly 44 are so assembled, smaller holes 82 align with holes 78 of lower louver assembly 44, and standard threaded connectors can be used to connect lens 28 to lower louver assembly 44. As shown in FIGS. 4B and 4C, lens 28 can also be positioned so that smaller holes 82 align with bosses 76, in which case lens 28 actually sits atop bosses 76. In this case, thread forming screws can be used to connect lens 28 to bosses 76.

Further with reference to lens 28, extending upward from bottom 38 is a bulb pedestal 84. As discussed in commonly-owned U.S. patent application Ser. No. 050,842, filed May 15, 1987, incorporated herein by reference, bulb pedestal 84 forms a pair of parallel elongate apertures 86 which receive individual contacts 32. A web or septum 88 extends along the entire length of bulb pedestal 84 and serves to electrically insulate contacts 32 from one another. Contacts 32 are held in place by fingers which spring outward and engage the inner surfaces of apertures 86.

Further with reference to FIG. 8, flange 34 forms a plurality of slots 90, 92 toward its inner periphery suitable for receiving the uppermost tips of legs 50 extending upward from top louver 40. Slots 90, spaced at 120° intervals, are used when four louvers are desired (see FIG. 4A); and slots 92, also spaced at 120° intervals, are used in the case of six louvers (see FIG. 4C). For reasons which will be made clear below, each slot 92 is spaced 50° from the nearest adjacent slot 90. The numbers "4" and "6" located adjacent slots 90 and 92, respectively, are noted. These numbers indicate where upper legs 50 should be located for proper assembly of bulb/lens assembly 12, depending on whether four or six louvers are used. For example, if four louvers are used, as shown in FIG. 4A, the upper legs 50 should be positioned relative to lens 28 such that one of the legs 50 resides in slot 90, labeled "4". When six louvers are used, shown in FIG. 4C, legs 50 should be adjusted so that one of the legs 50 is located within slot 92, labeled "6". On the other hand, when five louvers are used, shown in FIG. 4B, one of the legs 50 should actually be located beneath location "5", 10° to one side of the slot labeled "4". In this case, flange 34 actually rests on top of legs 50 and the upper tips of legs 50 do not reside in slots 90 or 92 formed by flange 34.

The 10° spacing between lens holes 82 and slots 90 is attributable to the 5° stagger between lower legs 46 and deep slots 62. Since there are two such staggers in the case of the four louver embodiment, due to the presence of two middle louvers 42, there must be 10° between holes 82 and slots 90, noting that holes 78 in louver assembly 44 are used in this case.

When five louvers are desired, lens 28 is set atop bosses 76, holes 82 are aligned with same, and fasteners extend therethrough. Since shallow slots 60 are used, these being aligned with legs 46, there is no need for a stagger or offset between holes 82 and location "5" on flange 34.

Finally, when six louvers are used, lens 28 again sits atop bosses 76, and holes 82 align with same. In this case, like the four louver embodiment, the deep slots 62 are used, resulting in a total of 20° of stagger; hence the 20° spacing between large holes 80 and slots 92 (given the fact that deep slots 62 of louver assembly 44 align with large holes 80 of lens 28 when lens 28 rests on bosses 76).

Flange 34 also forms three outer slots 100 which enable flange 34 to be connected in bayonet fashion to cap 52. That is, cap 52 forms three tabs (not shown) which project radially inward and these tabs are received by slots 100. On the outer rim of flange 34, in addition to slots 100, are ramps 102 which each extend from one edge of a slot 100 and grow progressively thicker toward the clockwise adjacent slot 100, as viewed in FIG. 8. Thus, when cap 52 is pushed and twisted onto lens 28, ramps 102 create an increasingly tighter fit to securely connect cap 52 to flange 34.

Referring again to FIG. 4, FIG. 4A illustrates use of four louvers, i.e., bottom louver assembly 44, top louver 40 and a pair of middle louvers 42. In this configuration, deeper slots 62 are used to receive downwardly extending legs 46, and upper upwardly extending legs 50 of top louver 40 are positioned relative to lens 28 such that their uppermost tips reside in slots 90. As can be seen in FIG. 4A, lens 28 is positioned such that bosses 76 extending upward from the cup portion of bottom louver assembly 44 are received by large apertures 80 in lens base 38. This creates a fairly short compact bulb/lens assembly with relatively small spacing between adjacent louvers. Thus, very little light is allowed to emanate radially, but is instead primarily directed downward. This light fixture is thought to have somewhat of an oriental look.

If more light is desired, or if more of a contemporary look is needed, five or six louvers can be used. FIG. 4B illustrates use of five louvers. In this case, lens 28 is positioned such that it rests on bosses 76 extending upward from lower louver assembly 44. Screws are used to connect the base 38 of lens 28 to bosses 76. Shallow slots 60 are used and upwardly extending legs 50 from upper louver 40 are positioned relative to lens 28 such that flange 34 rests on top of legs 50 in position "5" (shown in FIG. 8).

FIG. 4C shows six louvers being used. In this case, deeper slots 62 are again used, and legs 50 are positioned within slots "6" (92) in lens flange 34.

In the preferred embodiment shown in the Drawings there are only two available louver spacings, depending on whether the deep or the shallow slots (62 or 60) are used. However, those skilled in the art will recognize that additional spacings could be provided through the inclusion of additional slots having different depths. In fact, the "slot" could actually be in the nature of a continuous wedge which would afford infinite adjustment of inter-louver spacing.

Assembly Ring 18

Figure 3:
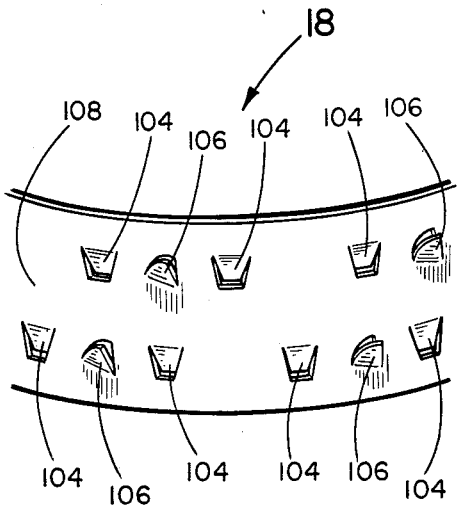
FIG. 3 is an enlarged partial view of the assembly ring of the fixture of FIG. 1.

Extending around cylindrical portion 70 of lower louver assembly 44 is assembly ring 18, an enlarged portion of which is shown in FIG. 3. Once bulb/lens assembly 12 is completed, it is connected to post 14 using assembly ring 18. Assembly ring 18 is preferably made of half-hard phosphor bronze and is configured to have inner and outer gripping fingers 104 and 106 which extend radially inward and outward, respectively. Inner fingers 104 are designed to bite into the outer surface of cylindrical portion 70 and outer fingers 106 similarly engage the inner surface of post 14 to provide a firm connection between bulb/lens assembly 12 and post 14. It should be noted that the inner fingers 104 of ring 18 are symmetrical and extend inward and downward so as to prevent assembly ring 18 from being axially removed from cylindrical portion 70. Outwardly extending fingers 106, on the other hand, are not symmetrical but instead have upper right hand corners, as shown in FIG. 3, which extend further upward and outward from the main surface 108 of ring 18. Thus, when the two components are assembled, the bulb/lens assembly 12 can be twisted in the clockwise direction relative to post 14 easier than in the counterclockwise direction to allow for ready assembly of the two components. It should be noted that assembly ring 18 is preferably manufactured in a strip having a flap or tab on one end and a slot on the other end; the flap is inserted into the slot to form the circular ring shown in the Drawings.

It should be noted that assembly ring 18 could be included as an integral part of bulb/lens assembly 12 rather than as a discrete part. That is, outer "fingers" suitable for gripping the inside of post 14 could be molded into cylindrical portion 70 of bulb/lens assembly 12.

A preferred embodiment of the invention is described above. Those skilled in the art will recognize that many embodiments are possible within the scope of the invention. Variations and modifications of the various parts and assemblies can certainly be made and still fall within the scope of the invention. Thus, the invention is limited only to the apparatus and method recited in the following claims, and equivalents thereto.

We claim:

1. A light fixture comprising:

(a) a light source; and (b) a plurality of louvers operatively disposed relative to the light source, wherein each louver comprises:

(i) a skirt; and (ii) a plurality of legs extending from the skirt suitable for engaging an adjacent louver, wherein the skirt forms a plurality of slots suitable for receiving the legs of the adjacent louver, some of the slots being shallow and some deep, wherein when the shallow slots are used adjacent louvers are in their most spaced state, and when the deep slots are used adjacent louvers are in their least spaced state, whereby the number of louvers and spacing therebetween can be adjusted depending on the desired appearance and light output.

2. The light fixture of claim 1, wherein the legs and slots are substantially T-shaped.

3. The light fixture of claim 1, wherein the deep and shallow slots overlap such that when the legs are in the shallow slots a portion of each of the legs extends into the adjoining deep slot.

4. A louver assembly suitable for use with a light fixture comprising a plurality of louvers, wherein each louver comprises:

(a) a skirt; and (b) a plurality of legs extending from the skirt suitable for engaging an adjacent louver, wherein the skirt forms a plurality of slots suitable for receiving the legs of the adjacent louvers, some of the slots being shallow and some deep, wherein when the shallow slots are used adjacent louvers are in their most spaced state, and when the deep slots are used adjacent louvers are in their least spaced state, whereby the number of louvers and spacing therebetween can be adjusted depending on the desired appearance and light output.

5. A light fixture comprising:

(a) a lower louver assembly comprising a cup-like base supporting a plurality of upwardly extending bosses;

(b) a plurality of middle louver assemblies;

(c) a lens comprising a sidewall; a circular flange extending radially outward from the top of the sidewall; and a bottom, wherein the bottom forms a plurality of apertures suitable for selectively receiving the lower louver assembly bosses; and (d) an upper louver assembly, wherein:

(i) each louver assembly comprises a skirt;

(ii) the middle and lower louver assemblies form deep and shallow slots;

(iii) the upper and middle louver assemblies comprise downwardly extending legs suitable for selectively engaging the slots; and (iv) the upper louver assembly comprises upwardly extending legs suitable for selectively engaging slots in the lens flange, wherein when the shallow slots are used the louver assemblies can be placed in their most spaced state, and when the deep slots are used the louver assemblies can be placed in their least spaced state, whereby the spacing between the louver assemblies can be adjusted depending on the desired appearance and light output.

6. The light fixture of claim 5, wherein when it is desirable to use a relatively small number of louver assemblies relatively close together the lens is adjusted relative to the lower louver assembly so that the lens apertures receive the bosses; and when it is desirable to use a relatively large number of louver assemblies relatively far apart the lens is adjusted relative to the lower louver assembly so that the lens apertures do not receive the bosses, but instead the lower louver assembly base rests atop the bosses.

7. A light fixture comprising:

(a) a bulb/lens assembly comprising a light source and a plurality of louvers operatively disposed relative to the light source, wherein each louver comprises:

(i) a skirt; and (ii) a plurality of legs extending from the skirt suitable for engaging an adjacent louver, wherein the skirt forms a plurality of slots suitable for receiving the legs of the adjacent louver, some of the slots being shallow and some deep, wherein when the shallow slots are used adjacent louvers are in their most spaced state, and when the deep slots are used adjacent louvers are in their least spaced state, whereby the number of louvers and spacing therebetween can be adjusted depending on the desired appearance and light output;

(b) a hollow post suitable for receiving at one end thereof the bulb/lens assembly; and (c) assembly ring means operatively connected to the bulb/lens assembly for connecting the bulb/lens assembly to the post, wherein the assembly ring means comprises a plurality of fingers suitable for engaging the post.

8. The light fixture of claim 7, wherein the bulb/lens assembly fits within the post and the assembly ring means comprises a band and a plurality of inner and outer fingers suitable for engaging the bulb/lens assembly and the post, respectively.

9. The light fixture of claim 7, wherein the bulb/lens assembly is injection molded and the post is extruded.

10. The light fixture of claim 7, wherein the assembly ring is metal.

11. The light fixture of claim 7, wherein the assembly ring inner fingers extend radially inward and downward and the assembly ring outer fingers extend radially outward and upward.

12. The light fixture of claim 7, wherein the inner fingers are symmetrical, thereby resisting turning in either direction in the same manner, and the outer fingers are asymmetrical, thereby permitting easier turning in one direction than the other.

* * * * *